US008540195B2

(12) United States Patent
Astwood

(10) Patent No.: US 8,540,195 B2
(45) Date of Patent: Sep. 24, 2013

(54) BAG HOLDING APPARATUS

(76) Inventor: Shirley E. Astwood, Kingwood, TX (US)

( * ) Notice: Subject to any disclaimer, the term of this patent is extended or adjusted under 35 U.S.C. 154(b) by 545 days.

(21) Appl. No.: 12/620,770

(22) Filed: Nov. 18, 2009

(65) Prior Publication Data

US 2010/0123051 A1 May 20, 2010

Related U.S. Application Data

(63) Continuation-in-part of application No. 12/271,965, filed on Nov. 17, 2008, now abandoned.

(51) Int. Cl.

| | |
|---|---|
| ***B65B 67/04*** | (2006.01) |
| *B65B 67/12* | (2006.01) |
| *A44B 1/04* | (2006.01) |
| *A41F 1/00* | (2006.01) |

(52) U.S. Cl.
USPC ..... 248/99; 248/100; 248/95; 24/614; 24/318

(58) Field of Classification Search
USPC ..... 24/614, 615, 318, 343
See application file for complete search history.

(56) References Cited

U.S. PATENT DOCUMENTS

| | | | | |
|---|---|---|---|---|
| 1,350,443 | A | 8/1920 | Edstrom | |
| 4,576,310 | A | 3/1986 | Isgar et al. | |
| 4,588,154 | A * | 5/1986 | Basore | 248/99 |
| 4,695,020 | A | 9/1987 | Collins | |
| 4,750,695 | A | 6/1988 | Greenhouse | |
| 4,923,087 | A | 5/1990 | Burrows | |
| 4,930,735 | A | 6/1990 | Lax | |
| 5,100,087 | A * | 3/1992 | Ashby | 248/97 |
| 5,562,213 | A | 10/1996 | Wile | |
| D422,891 | S | 4/2000 | Ohlman, II | |
| 6,152,408 | A | 11/2000 | O'Grady | |
| 6,517,033 | B2 * | 2/2003 | Russell et al. | 248/99 |
| D480,296 | S | 10/2003 | Scola | |
| 6,715,260 | B1 | 4/2004 | DeMatteis | |
| 6,726,156 | B1 | 4/2004 | Scola | |
| 2005/0114216 | A1 | 5/2005 | Lantz et al. | |

FOREIGN PATENT DOCUMENTS

| | | | |
|---|---|---|---|
| GB | 2294193 | A | 10/1994 |

OTHER PUBLICATIONS

Smith, E.; Final Office Action; Dec. 17, 2009; U.S. Appl. No. 12/271,965; USPTO.

* cited by examiner

*Primary Examiner* — Jonathan Liu
*Assistant Examiner* — Erin W Smith
(74) *Attorney, Agent, or Firm* — Robert C. Rolnik

(57) ABSTRACT

Disclosed is a bag holder frame having a first rectangular ring-shaped member and a second rectangular ring-shaped member. The first rectangular ring-shaped member may have a first cross-member and a second cross-member connected together via a first base and a first top portion, wherein the first top portion has a first slot and a second slot. The second rectangular ring-shaped member may have a third cross-member and a fourth cross-member connected together via a second base and a second top portion, wherein the second top portion has a third slot and a fourth slot. In addition, the first cross-member and the third cross-member are connected via a first hinge present at a medial portion of the first cross-member and the third cross-member, wherein the second cross-member and the fourth cross-member are connected via a second hinge present at a medial portion of the second cross-member.

2 Claims, 8 Drawing Sheets

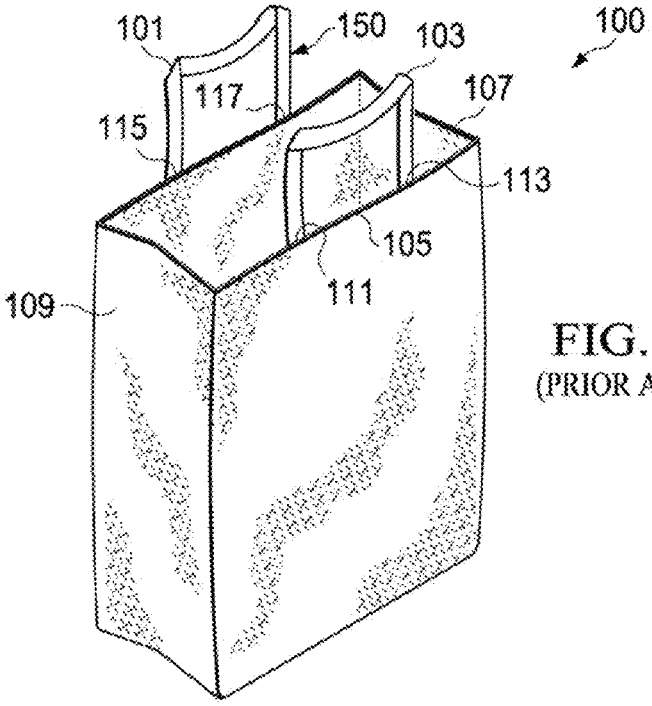
FIG. 1
(PRIOR ART)
FIG. 2
(PRIOR ART)
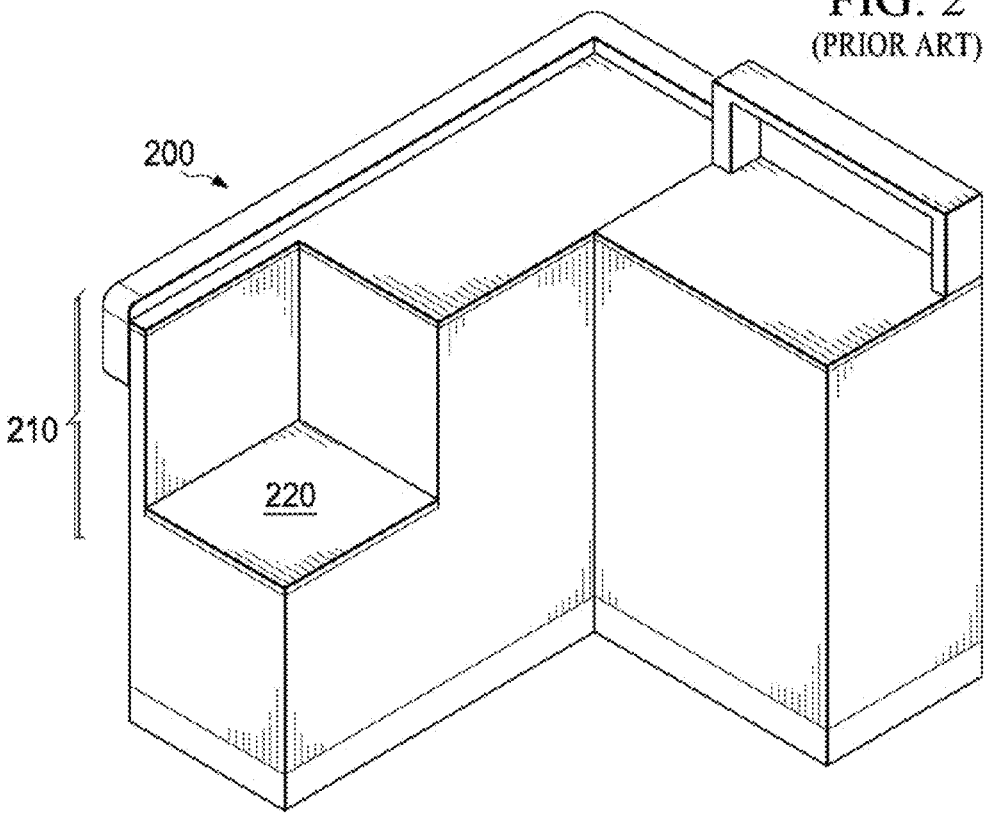

BAG HOLDING APPARATUS

CROSS REFERENCE TO RELATED APPLICATIONS

This application is a continuation application of, and claims the benefit of, and priority to, U.S. application Ser. No. 12/271,965, filed Nov. 17, 2008, the entirety of which is incorporated herein by reference.

BACKGROUND OF THE INVENTION

1. Field of the Invention

The present invention relates generally to an apparatus for supporting bags. More specifically, the present invention relates to an apparatus for providing a bag opening in a generally horizontal position so that the bag may be loaded.

2. Description of the Related Art

Grocery shoppers have responded to the trend of environmental awareness by using durable shopping bags that are re-used for multiple shopping outings.

Manufacturers of bag holding apparatus have built bag holders currently in use to take advantage of mass-produced disposable bags. A disposable bag of this type is typically made of a lightweight plastic that is amenable to folding the bag into a roughly square form. Storeowners have benefitted from such a bag design since such bags can be bundled into a stack and dispensed from a compact location attached to a bag holder.

One typical disposable bag form is the 'T-shirt' bag. The t-shirt bag comprises two large panels that form straps. Such a bag, when viewed from the side, resembles a sleeve-less T-shirt. Holes for grasping the handles are made in a pleated portion that is generally not visible when the bags are placed in their stacked form by the manufacturer. Accordingly, the pleated side is invariably made to be expandable when the bag is loaded or carried. The mouth of such bags is chiefly made up of sides that are formed by two pleated sides and two unpleated or broad sides. The unpleated sides are wider than the pleated sides.

Such bags, being highly flexible, are generally best presented for loading by applying tension between the two handles. Each handle joins to the body of the bag by two roots.

A root is the part of the bag where a handle joins to the main body of the bag. Accordingly, each handle has two roots, and weight is generally distributed equally to each root.

Prior art bag holders of disposable bags rely on the pleated sides, from which the handles rise, being shorter than the unpleated sides. Accordingly, in order to place the mouth of such bags into a loading position, the prior art holders generally support a handle by the roots so as to keep the roots of a handle far from the roots of a second handle. More specifically, each root of a handle is held closer to each other than the distance between two roots of different handles. See, for example, U.S. Pat. Nos. 4,576,310, 4,695,020, and 6,726,156.

In contrast, a re-usable bag, as shown in FIG. 1, moves left handles 101 and right handle 103 so that the roots of a handle are placed on the broader side 105 of the mouth of the bag. Consequently, the narrower sides 107 and 109 of such bags lack handles. Prior art bag holders could hold such a re-usable bag, however, in order to leave a considerable slack in the handles so that the root of the handle falls or otherwise fails to develop tension on the bag mouth. Other holders in the art can also create unwanted puckering in the mouth of the bag, for the reason that the roots 111, 113, 115, and 117 of the handles are supported at a width far wider than the narrow side, for example, side 109, that separates the side to which each handle attaches. In addition, the existing holders fail to account for reusable bags that have arc portions 150 that are larger than the material provided as handles in the plastic bags. Thus, when a reusable bag having proportions shown in FIG. 1 is used with a prior art support, roots 111, 113, 115, and 117 tend to dangle below the supported position of the arc portion 150 of each handle. Furthermore, prior art bag holders can also leave unwanted slack in the handles and/or bag, which can lead to the bag collapsing while loading the bag.

The use of reusable bags at the checkout station is problematic in that the bags lack an adequate support mechanism, unlike the currently used disposable plastic bags. In particular, a need exists to hold open such durable bags, regardless of size of the bag.

SUMMARY OF THE INVENTION

The present invention provides a bag holder for supporting a flexible bag having a first handle and a second handle, each handle having a first root connected to the bag, a second root connected to the bag and an arc portion linking the first root to the second root. The bag holder may comprise a frame having a substantially horizontal member. A stand fastener may elevate a top portion of the frame when attached to a stand. A first slot may attach to a second slot formed from the substantially horizontal member of the frame, wherein the first slot is configured to support the first handle at the first root and second root. A first arc portion fastener can attach to the frame. A third slot may indirectly attach to the frame and couple to the second slot, wherein the third slot is approximately tangential to and horizontally displaced from the second slot as compared to a line connecting the first slot to the second slot. In addition, a second arc portion fastener may be coupled to the frame.

A bag holder for supporting a flexible bag having a first handle and a second handle, each handle having a first root connected to the bag, a second root connected to the bag and an arc portion linking the first root to the second root. The bag holder may comprise a first cross-member and a second cross-member connected to the first substantially horizontal member at a top of the first cross-member and at a top of the second cross-member. The first cross-member may further be connected to the second cross-member by a first substantially horizontal base at a bottom of the first cross-member and the bottom of the second cross-member. Further, the bag holder may include a third cross-member and a fourth cross-member connected to the third cross-member by a second substantially horizontal member at a top of the third cross-member and at a top of the fourth cross-member. The third cross-member is connected to the fourth cross-member by a second substantially horizontal base at a bottom of the third cross-member and a bottom of the fourth cross-member. The first cross-member and the third cross-member can be rotatively hinged together at a medial portion of the first cross-member and a medial portion of the third cross-member. In addition, the second cross-member and the fourth cross-member can be rotatively hinged together at a medial portion of the second cross-member and a medial portion of the fourth cross-member.

A bag holder for supporting a flexible bag having a first handle and a second handle, each handle having a first root connected to the bag, a second root connected to the bag and an arc portion linking the first root to the second root. The bag holder may comprise a frame having a first rectangular ring-shaped member and a second rectangular ring-shaped member. The first rectangular ring-shaped member may have a first cross-member and a second cross-member connected together via a first base and a first top portion, wherein the first top portion has a first slot and a second slot. The second rectangular ring-shaped member may have a third cross-member and a fourth cross-member connected together via a second base and a second top portion, wherein the second top portion has a third slot and a fourth slot. Moreover, the first cross-member and the third cross-member are connected via a first hinge present at a medial portion of the first cross-member and the third cross-member, wherein the second cross-member and the fourth cross-member are connected via a second hinge present at a medial portion of the second cross-member. In addition, a first arc portion fastener may extend upwards from the first base, and a second arc portion fastener may extend upwards from the second base.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1 is a prior art reusable bag;

FIG. 2 is a prior art checkout stand or counter;

DETAILED DESCRIPTION OF THE PREFERRED EMBODIMENT

FIG. 2 is a prior art checkout stand or counter. Stand 200 provides a flat surface for items to be reviewed for the value or price associated with the item. Stand 200 includes bagging area 210 including surface 220 on which bagged groceries or other products may be placed.

Figure 6:
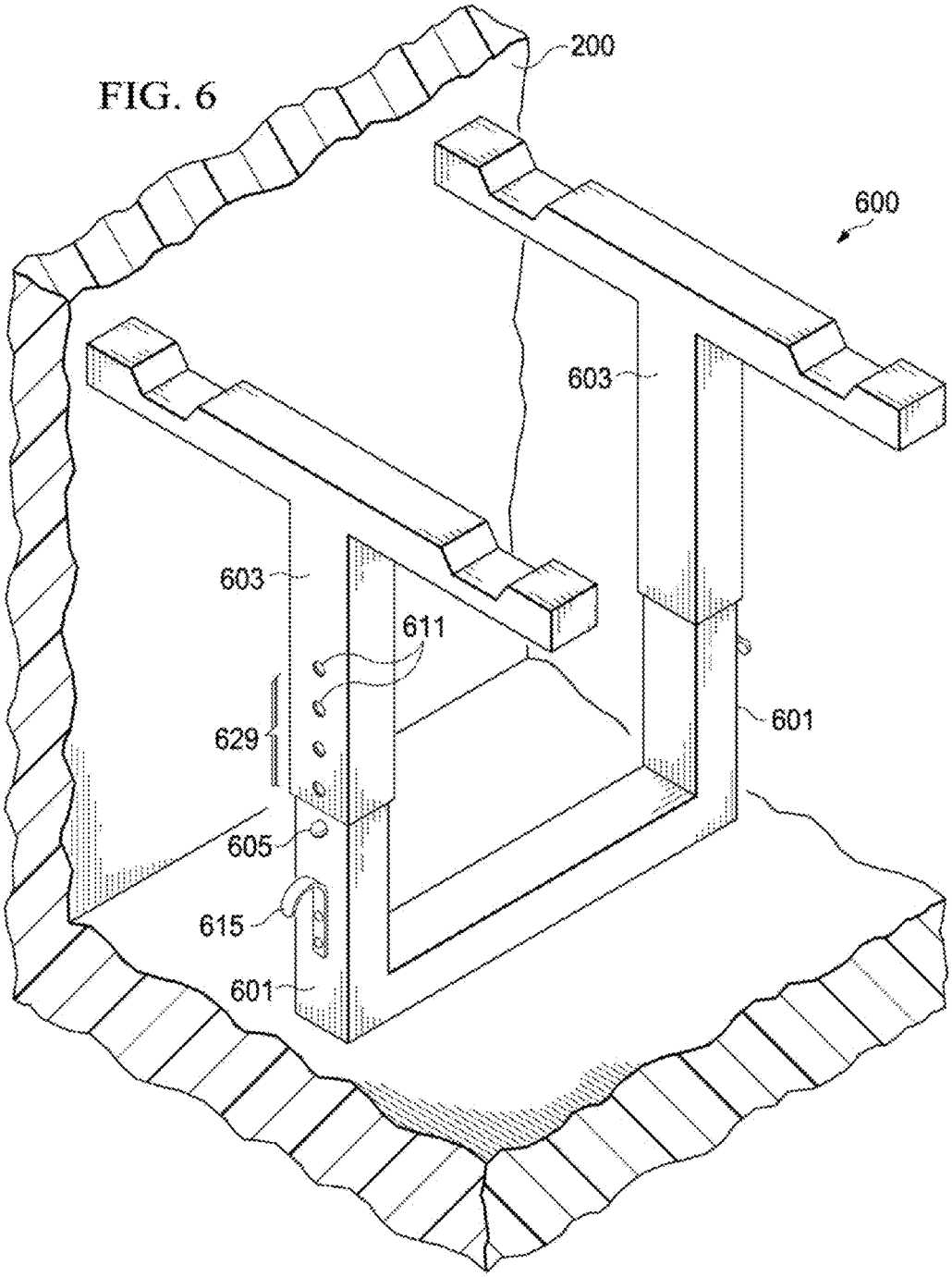
FIG. 6 is a bag holder with a vertically adjustable handle support in accordance with an illustrative embodiment of the invention.
Figure 10:
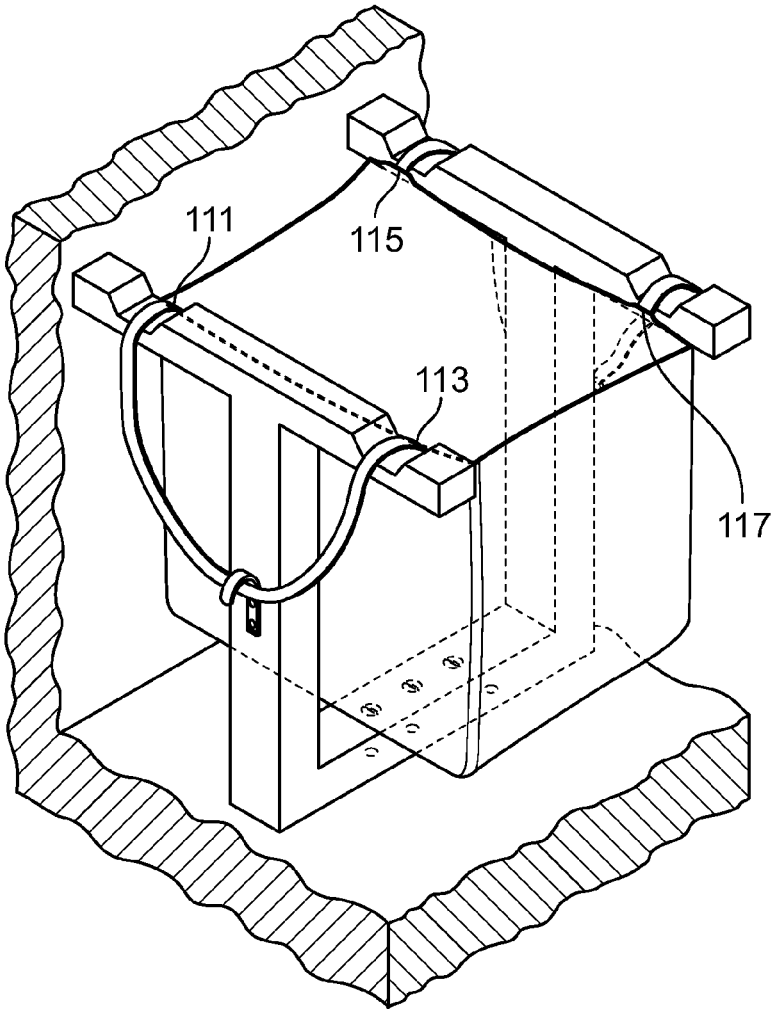

FIG. 10 is a diagram that shows the placement of the bag such that root handles fall on the slots depicted in FIG. 6 in accordance with an embodiment of the invention.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

The illustrative embodiments provide an apparatus for suspending a reusable bag at or near the roots of the bag in a generally upright manner. One or more embodiments may permit a checkout clerk to adjust height and width of one or more handle supports to accommodate bags of varying heights and widths.

Figure 3:
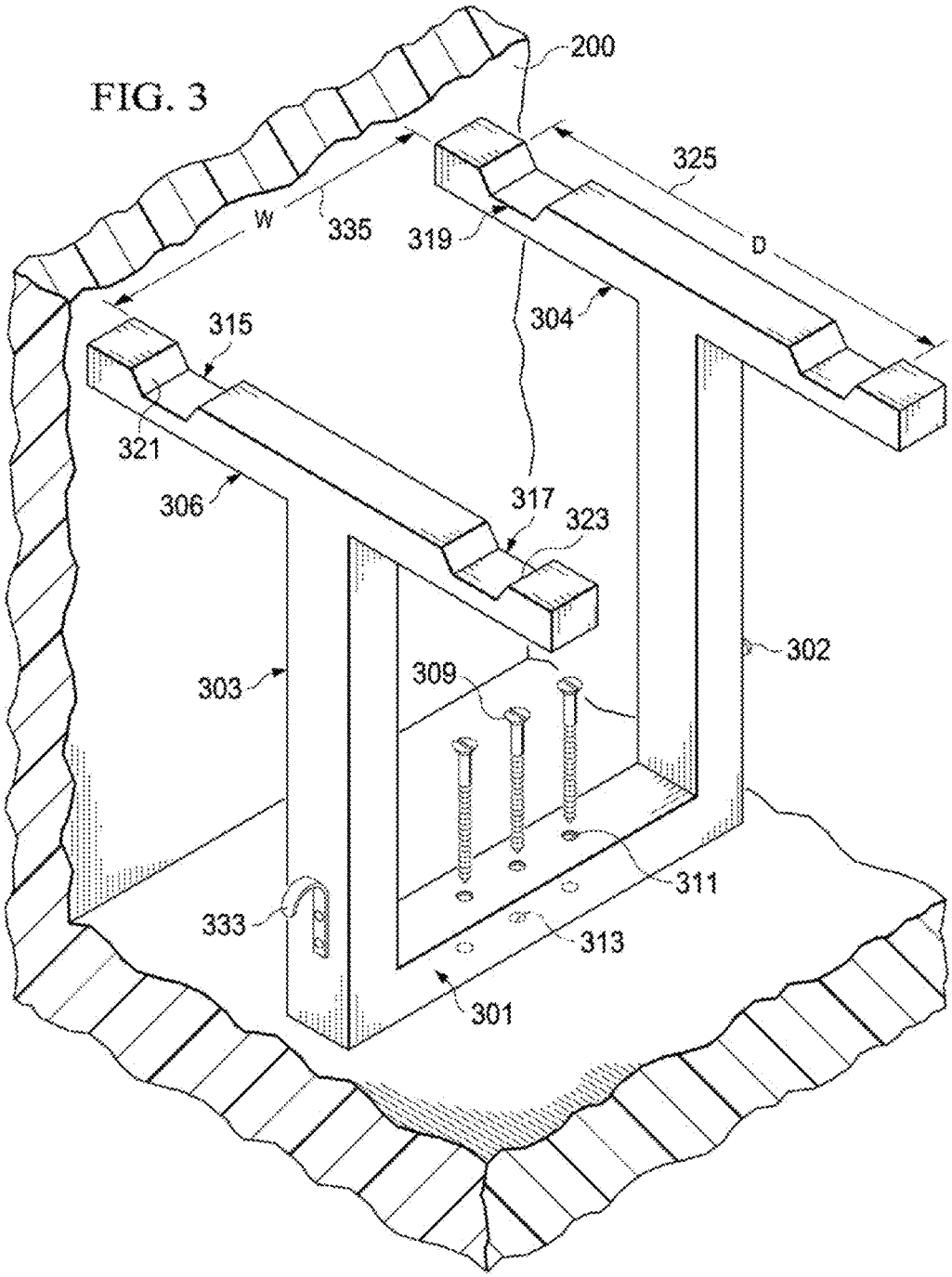
FIG. 3 is a bag holder in accordance with an illustrative embodiment of the invention.

FIG. 3 is a bag holder in accordance with an illustrative embodiment of the invention. Frame 301 is held in place with a stand fastener. A stand fastener is hardware that attaches the frame to a stand. The stand fastener may be, for example, screws, a bracket, welds, or any other fastening apparatus. A frame may be bolted to stand 200 using screws 309. Outer access hole 311 permits the screw to be inserted through the top of the frame. Lower screw hole 313 may be fastened by a screw head to stand 200 when the frame is assembled to the stand.

First slot 315 has first slot outer edge 321. Second slot 317 has second slot outer edge 323. A slot is a groove or indentation or other depression in a substantially horizontal member that allows for a strap, or other material that forms a handle, to be placed within the slot. Accordingly, a handle support is an apparatus that can support a bag at or near the roots of a handle. As depicted in FIG. 3, handle support 306 is a roughly 'T' shaped member that extends upwards from frame 301. A slot outer edge is a discontinuity in the slot that either forces a draped handle to fall into the slot, or causes a draped handle to fall away from the slot. The distance between first slot and second slot is distance 325. A depth is the distance along a substantially horizontal support between outer slot edges. First handle support, within which the first slot 315 and second slot 317 are located, is located width 335 from a second handle support. A width is a measurement of distance between slots for a handle support where the handle support is at a level that is common to the second handle support. In other words, the level, if adjustable, is adjusted to be a same vertical distance so that the slots are approximately level with respect to each other. Distance 325 is greater than width 335. In other words, first slot 315 and third 319 slot when arranged at a common level is smaller than a depth or a distance between first slot 315 and the second slot 317. Each handle support may have a hook, for example, hook 333. Similarly, a right handle support 304, has hook 302 that may be arranged to mirror the hook orientation of hook 333.

A checkout clerk may use a reusable bag of the prior art, for example, as shown in FIG. 1 with any one of the embodiments shown herein. For example, when using the illustrative embodiment bag holder of FIG. 3, a checkout clerk may place the body of the bag between left handle support 306, and right handle support 304. Next, the checkout clerk may place left handle 101, and in particular the arc portion, under hook 333 of FIG. 3 so that the bag's left side is support by the roots at first slot 315 and second slot 317. Similarly, the checkout clerk may place right handle 103 under hook 302 so that the bag's right side is supported by the roots using at least third slot 319. The bag may then be loaded in a manner where the opening of the bag can be kept in a roughly rectangular form. Unloading may simply involve the checkout clerk removing each handle from the respective hook, and lifting the bag from between the handle supports.

Figure 4:
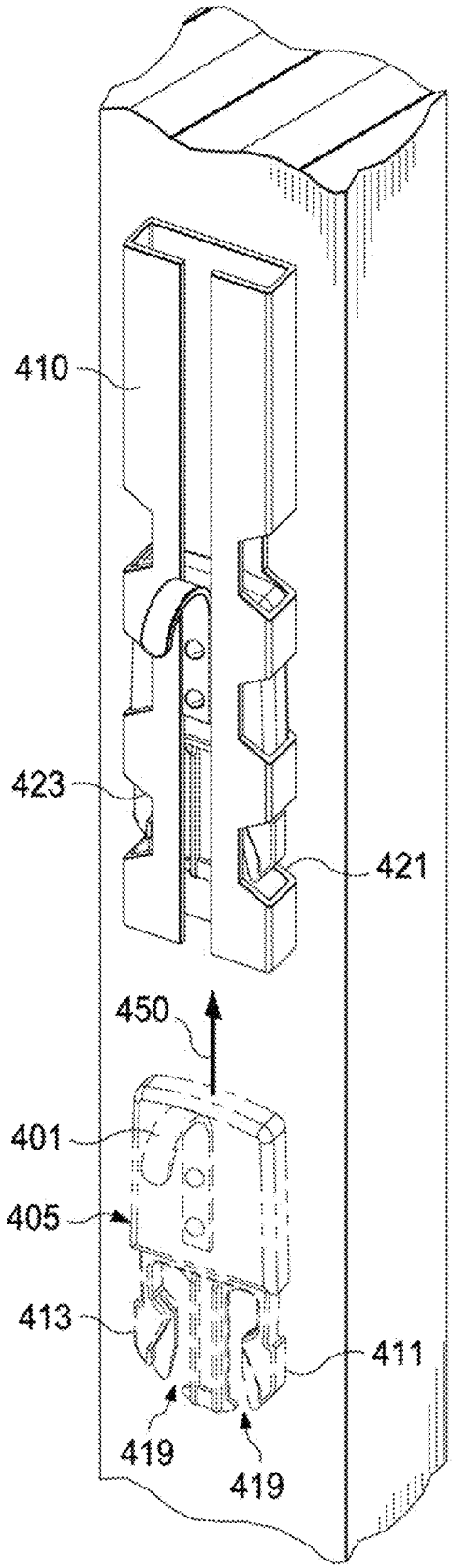
FIG. 4 is a cutaway of a vertical member within which an adjustable hook travels in accordance with an illustrative embodiment of the invention.

FIG. 4 is a cutaway view of a vertical member within which an adjustable hook travels in accordance with an illustrative embodiment of the invention. Vertical member 400 may be used instead of vertical member 303 and hook 333 of FIG. 3. Vertical member 400 may support a track 410 that provides a partially enclosed groove for a hook carrier. Hook 401 is bolted on to hook carrier 405 or otherwise attached thereto. The hook carrier may be made from a resilient elastomer that provides some flexibility. Hook carrier 405 may travel along line 450 within track 410. Tine 411 and tine 413, attached to hook carrier 405, may provide concave curved surfaces that may flex inwardly as the hook carrier is placed in the track. Conversely, tine 411 and tine 413 may flex outwardly and snap curved surfaces in place when tine 411 reaches an opposing hole 421 and tine 413 reaches opposing hole 423. Accordingly, a checkout clerk may move hook 401 by grasping opposing tines 411 and 413, and pressing the tines inward toward gap 419 to release the tines from their respective holes. Thus, hook 401 may be adjusted to receive and hold handles of varying lengths.

An alternative embodiment may include a support track without holes. If formed without holes, a hook carrier may slide without impediment by tines entering holes. Instead, the hook carrier may be biased with additional weight to provide a downward force to offset the weight of a bag tugging at a handle over vertical member 400.

Figure 5:
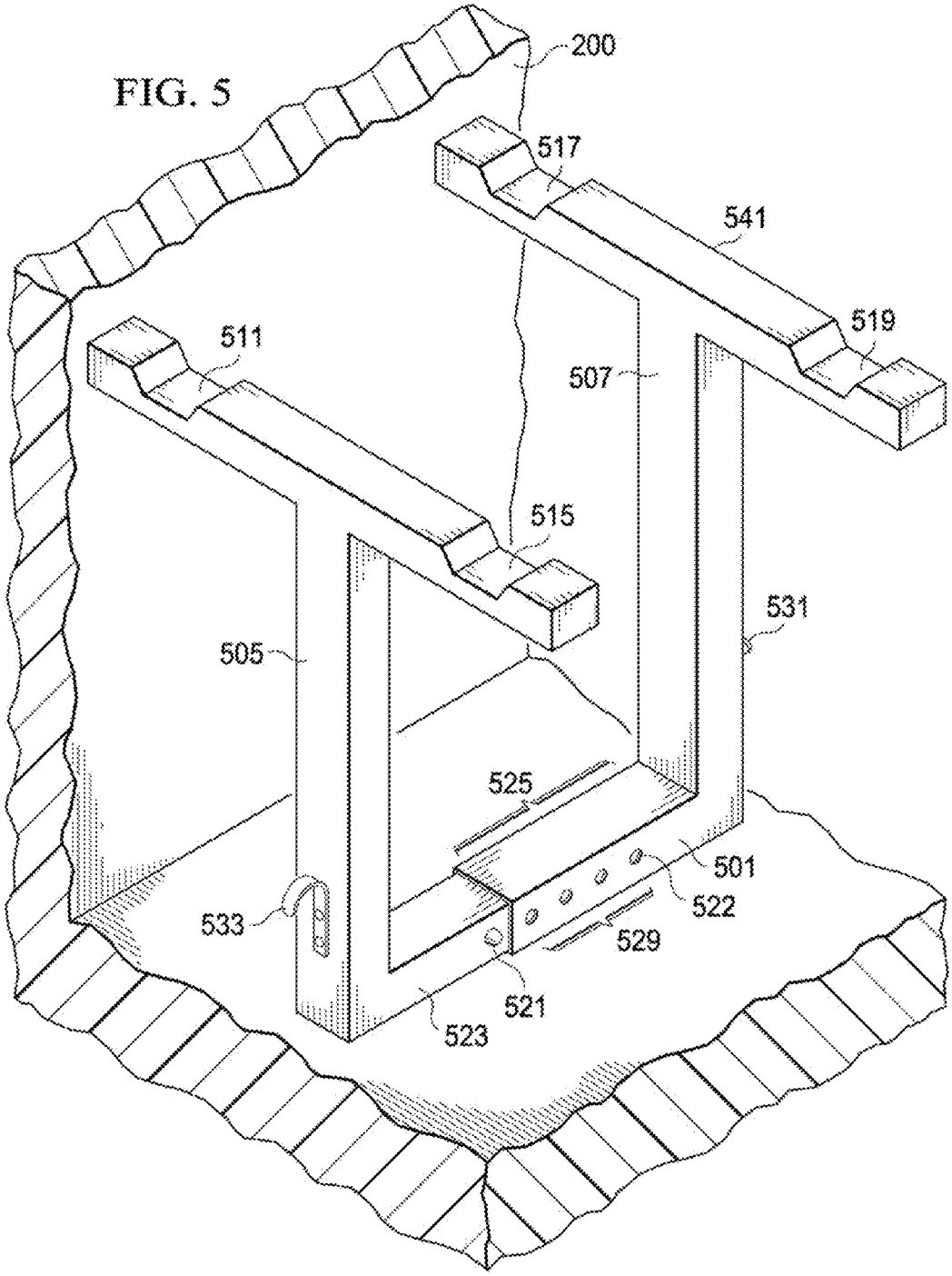
FIG. 5 is a bag holder in accordance with an illustrative embodiment of the invention.

FIG. 5 is a bag holder in accordance with an illustrative embodiment of the invention. Frame 501 may be fastened to stand 200. Stand 200 shown in cutaway form, may be stand 200 of FIG. 2. A frame is a core piece of material that couples to a stand or floor to provide stability for the bag holder. Frame 501 may attach to a handle support. The handle support may be formed from a support member 507 and substantially horizontal member 541. A support member is a support that may support the weight of a bag as distributed through the roots of a handle. A substantially horizontal member is attached to the support member to provide grooves or slots within which the handle roots may be placed such that the roots are in a consistent position. Within substantially horizontal member 541 is first slot 517 and second slot 519.

A frame may be a support track. A support track is a device that provides a slidable groove, raceway, or other track that allows a second handle support to move towards or from a first handle support. The support track 525 of frame 501 may be a tube, for example, having a rectangular cross-section. A narrower tube may be placed within the support track, for example, slidable tube 523. A track carrier is a portion of a handle support that slidably engages to the frame or support track. In this case, slidable tube 523 is the track carrier. Slidable tube 523 may have a displaceable pin that may be biased outward from the slidable tube. A displaceable pin is a rounded pin that projects from a tube or other enclosing structure such that the pin is biased outward from the tube. The displaceable pin is arranged so that it may fit within a hole in an outer tube through which the first tube travels, as well as may be pressed out of alignment with the hole by finger pressure. Accordingly, as slidable tube 523 progresses into support track of frame 501, displaceable pin 521 may be seated in hole 522, formed in support track 525, to provide a locked horizontal position to support member 505. A position can be a configuration of a horizontal member to a height or lateral location selected by a checkout clerk. Conversely, a checkout clerk may apply finger pressure to displaceable pin 521 to push the pin substantially inside the support track of frame 501 so that the slidable tube 523 may be adjusted sideways to accommodate a bag of a width different than the width of the former position of the handle supports. Once the slidable tube is arranged so that the handle supports reach the width that the checkout clerk desires, the clerk may permit the displaceable pin 521 to enter hole 522 among holes 529 of support track 525, to provide a stable width to the handle supports. It is appreciated that equivalent additional mechanical features may provide equivalent detent retention of a handle support, for example, the displaceable pin 521 may seat into alternate embodiment inner-wall concavities in an outer tube. Alternatively, elastomeric plastic parts may be used in place of displaceable pin 521 to provide nubs that extend into holes along a support track.

Thus, slidable tube 523 may support a second handle support comprising support member 505 as well as a substantially horizontal support. Within the second handle support may be third slot 511 and fourth slot 515. Third slot 511 is approximately tangential to and horizontally displaced from the second slot 519, as compared to a line (not shown) connecting first slot 517 and second slot 519.

A reusable bag's handle draped over first slot 517 and second slot 519 may hang in an arc below the substantially horizontal member. An arc portion fastener is a device to grasp, clasp, hook or otherwise hold a handle or arc portion of a bag. An arc portion, as shown by arc portion 150 in FIG. 1, is a part of a handle that is grasped by a person when moving, stowing, or otherwise positioning a bag by way of moving the handles of the bag. The arc portion may have curved parts and/or parts that are roughly straight. A checkout clerk may use an arc portion fastener to grasp and hold the arc portion of the handle to prevent the bag from falling through the bag holder. The arc portion fastener may be, for example, a hook or other suitable fastener. The arc portion fastener may be, for example, hook 531 attached to vertical support 507 or hook 533 attached to vertical support 505. Hook 533 may be substantially below third slot 511 and/or fourth slot 515. Hook 531 may be substantially below first slot 517 and/or second slot 519.

FIG. 6 is a bag holder with a vertically adjustable handle support in accordance with an illustrative embodiment of the invention. Handle support 600 is made up of an adjustable post that moves around and vertically over vertical member 601. An adjustable post is a post or other member that can be adjusted to a locking position so that a handle support raises or lowers the points where handle roots drape over the handle support. An adjustable post may be, for example, slidable tube 603 or any other mechanism to vary the height of handle support. Displaceable pin 605 may provide several positions at which handle support 600 may be locked into place to accommodate bags having handles of varying lengths. A checkout clerk may adjust the positions by extending or reducing the length a handle is pulled by hook 615 over a substantially horizontal member of the handle support. Accordingly, displaceable pin 605 may fit within hole 611 selected from among holes 629, in slidable tube 603, by a checkout clerk to arrange slots to hold roots at an elevation suitable to the bag.

Figure 7:
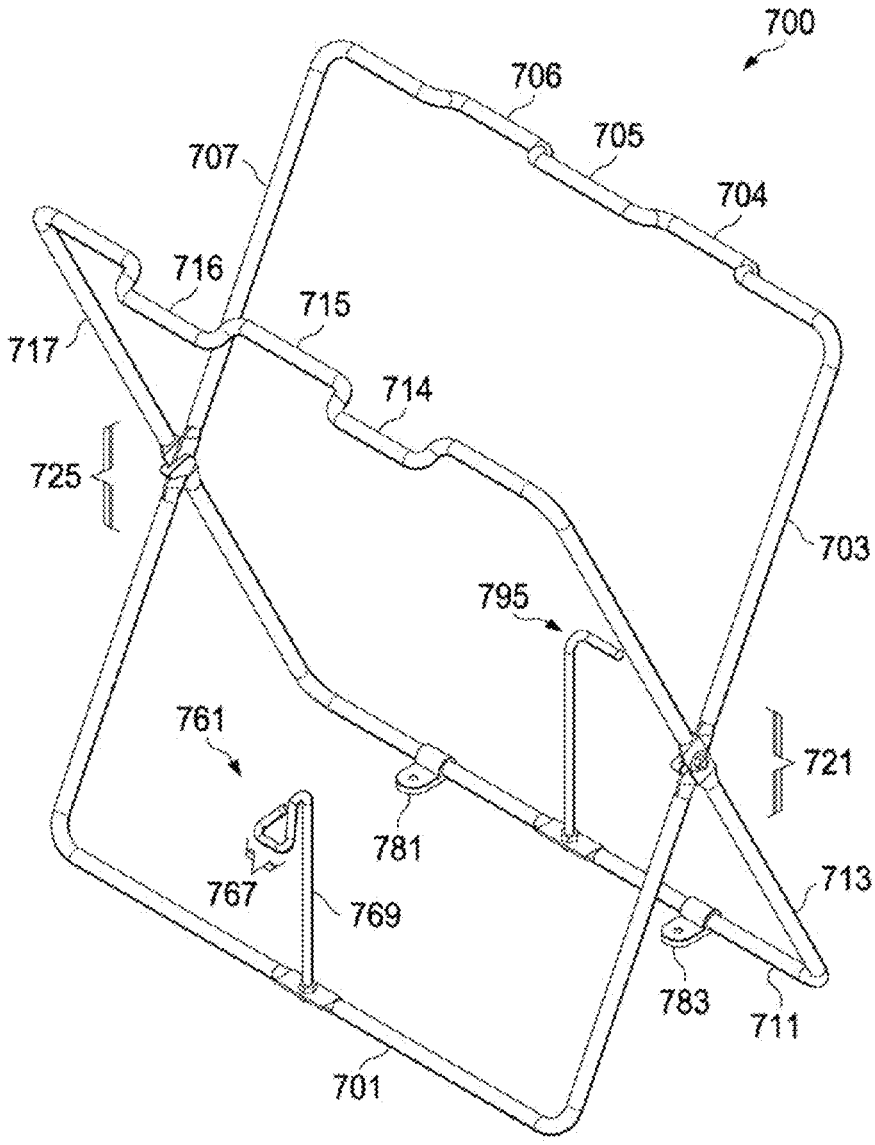
FIG. 7 is a bag holder having a frame made at least of two generally rectangular ring-shaped members in accordance with an illustrative embodiment of the invention.

FIG. 7 is a bag holder having a frame made at least of two generally rectangular ring-shaped members in accordance with an illustrative embodiment of the invention. Rectangular ring-shaped bag holder 700 contains a first rectangular ring-shaped member and may include four contiguous parts. These parts may comprise first base 701, first cross-member 703, first top portion 705, and second cross-member 707.

"Ring-shaped" is a term that describes a material shaped in a circuit such that a hole extends through the material. The ring can be arranged generally as a square or rectangular shape. Perturbations in the perimeter of the rectangle are permissible without departing from a generally rectangular-shaped rings structure. In other words, a shape can be both ring-shaped and rectangular-shaped despite kinks in the sides of the rectangle. In addition, additional features may extend from the material, and holes may be placed on the material, without departing from the generally ring-shaped character. In the examples given above, the hole is sufficiently large to admit a typical re-usable grocery bag within the hole despite a typical load being placed in the grocery bag. In addition, the rectangular ring-shaped material may have holes and other extensions that permit the rectangular ring-shaped material to cooperate with an additional rectangular ring-shaped material to form a frame that can unfold.

A second rectangular ring-shaped member is assembled to the first rectangular ring-shaped member in a manner that permits the rectangular ring shaped members to fold to a relatively flat arrangement, or be expanded into a form useful for holding bags, such as grocery bags, in an open and generally upright configuration. The second rectangular ring-shaped member may include four contiguous parts. These parts may comprise second base 711, third cross-member 713, second top portion 715, and fourth cross-member 717. The top portions may be substantially horizontal members. The cross-members can prop each other up by being hinged at medial portions of each respective cross-member. A medial portion is the material at, and extending around, the mid-point of a cross-member. Furthermore, a hinge can be located at the medial portions of two cross-members so that for each pairing of hinged cross-members, the axis of a first hinge extends through the second hinge. A hinge is a material that supports a pin and admits a pin into a second portion so that the second portion may rotate about the pin and either support the pin, or be supported by the pin. The pin can be part of the hinge.

Accordingly, first hinge 721 and second hinge 725 may cooperate together to permit bag holder 700 to fold and unfold. Moreover, hinge 721 may include a stop that can allow gravity to extend the cross-members into an X-shape or open position such that each slot is elevated above a base. Slots include slot 704 and slot 706 in first top portion, and slot 714 and slot 716 in second top portion 715. While in the open position, each base may rest on a counter surface. A base is the part of each rectangular ring-shaped member that is located at the bottom of the member when positioned to receive a bag or otherwise hold the bag.

Each base can be fastened to a counter surface by use of mounting hardware. Mounting hardware is hardware that prevents lateral travel of the base. Mounting hardware can include strap 781 and strap 783. Use of straps only on one base may permit folding and stowing of a bag holder when not required. Furthermore, the straps can permit counter surfaces to be used for other purposes by permitting one base to be flattened against the second base when folding the bag holder by using the hinges. Mounting hardware may be, for example, screws, hooks or other suitable mounts that capture at least one base and prevent its lateral movement.

Extending from each base is an arc portion fastener. First base 701 supports first arc portion fastener 761. Second base 711 supports second arc portion fastener 795. Each arc portion fastener may have an hourglass shape and one or more distal ends. An hourglass shape is a shape of an arc portion fastener where the width of the distal end or distal ends (including space between the ends) is wider than a width of the arc portion fastener nearer the base. Accordingly, arc portion fasteners that are forked or that have a spatula shape are hourglass shaped, since the forked ends diverge from a narrow cross-section. A cross-section is a plane that extends horizontally through a part. If the plane cuts through two parts of a forked portion of the arc portion fastener, the combined distance between outermost edges of the portions are used for measuring width or narrowness at that cross-section.

The arc-portion fastener, in some embodiments, may be hooked. Depicted in FIG. 7 is first arc-portion fastener 761 having a distal end 767 that is wide as compared to a body portion 769 that is narrower than the distal end. In addition, the distal end may extend outward in relation to a bag. Such portions of an arc portion fastener that extend from the body portion may extend angled downward toward the distal end, extend in a horizontal manner, or extend angled upward toward the distal end.

Figure 8A:
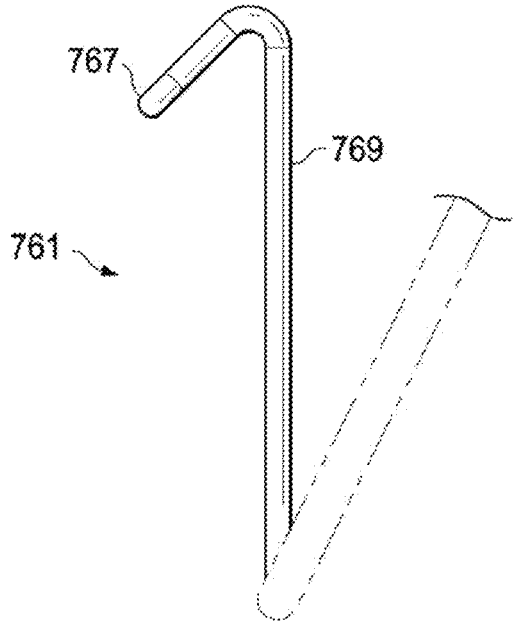
FIG. 8A is a first side view of the arc portion fastener of FIG. 7 in accordance with an illustrative embodiment of the invention.
Figure 8B:
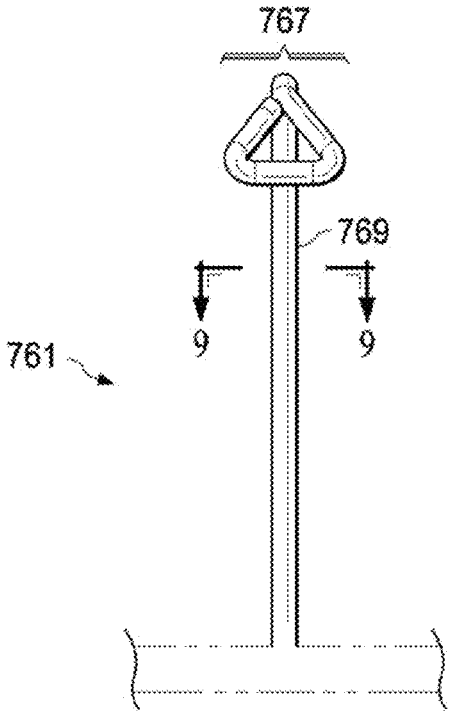
FIG. 8B is a second side view of the arc portion fastener of FIG. 7 in accordance with an illustrative embodiment of the invention.

FIG. 8A is a first side view of the arc portion fastener of FIG. 7 in accordance with an illustrative embodiment of the invention. FIG. 8B is a second side view of the arc portion fastener of FIG. 7 in accordance with an illustrative embodiment of the invention. Each rectangular ring-shaped member may be flat and accordingly occupy a plane. The term "occupy a plane" means that substantial portions of each of the base, top portion, and the cross-members of a rectangular ring-shaped member are intersected along their respective lengths by a plane. Portions of each rectangular ring-shaped portion may rise above or fall below the plane. Nevertheless, the plane passes through substantial portions of each base, top portion and cross-member. Each arc portion fastener bends outwards from the plane generally occupied by the rectangular ring-shaped member.

FIG. 8B also shows a cross-sectional plane taken between markings "9". This cross-sectional plane or body portion cross-section is narrower than a cross section taken at the distal end, as seen as distal end 767 in FIG. 8A.

Figure 9:
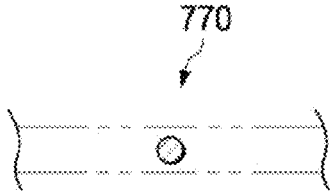
FIG. 9 is a cross-section view of a body portion cross-section for the arc portion fastener in accordance with an illustrative embodiment of the invention.

FIG. 9 is a cross-section view of a body portion cross-section for the arc portion fastener in accordance with an illustrative embodiment of the invention. Body portion cross-section 770 is a section of the arc portion fastener taken at the body portion.

FIG. 10 is a diagram that shows the placement of the bag such that root handles fall on the slots depicted in FIG. 6 in accordance with an embodiment of the invention.

The illustrative embodiments provide an apparatus for suspending a reusable bag at or near the roots of the bag in a generally upright manner. Several alternate manners of adjusting the handle supports have been shown to arrange slots for substantially horizontal members to be elevated to a level and other positions as desired by a checkout clerk.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A bag holder for supporting a flexible bag having a first handle and a second handle, each handle having a first root connected to the bag, a second root connected to the bag and an arc portion linking the first root to the second root, the bag holder comprising:

a frame having first and second substantially horizontal members that are parallel to each other and are located in the same horizontal plane, wherein the first and-second substantially horizontal members each has a first slot and a second slot;

wherein one of the first slots is configured to support the first handle or the second handle at the first root or second root, wherein the first substantially horizontal member has a first vertical member extending downward therefrom and the second substantially horizontal member has a second vertical member extending downward therefrom and wherein each of the first and second substantially vertical members are connected via a third substantially horizontal member; a first hook for anchoring the first arc portion to the first vertical member frame substantially below the first slot of the first substantially horizontal member; and a second hook for anchoring the second arc portion to the second vertical member the first slot of the second substantially horizontal member, wherein the first hook is connected to a means for pulling away from the first substantially horizontal member.

2. A bag holder for supporting a flexible bag having a first handle and a second handle, each handle having a first root connected to the bag, a second root connected to the bag and an arc portion linking the first root to the second root, the bag holder comprising:

a frame having a first substantially horizontal member attached to a first member extending upwards from the frame; a first slot and a second slot within the first substantially horizontal member, wherein the first slot and the second slot are configured to support the first or second handle at the first root and second root, respectively; a first hook attached to the first member for anchoring the first arc portion below the first slot substantially below the first slot;

a second member extending upwards from the frame to provide a third slot at a right angle to and horizontally from the second slot as compared to a line connecting the first slot to the second slot; and a second hook attached to the second member for anchoring the second arc portion substantially below the third slot, wherein the first hook is vertically adjustable and the second hook is vertically adjustable.

* * * * *